US008919443B2

(12) United States Patent
Parker et al.

(10) Patent No.: US 8,919,443 B2
(45) Date of Patent: Dec. 30, 2014

(54) METHOD FOR GENERATING DISCRETE FRACTURE INITIATION SITES AND PROPAGATING DOMINANT PLANAR FRACTURES THEREFROM

(75) Inventors: Mark Allen Parker, Lindale, TX (US); Neil Joseph Modeland, Gladewater, TX (US); Cam Le, Houston, TX (US); Kenneth Lee Borgen, Midland, TX (US); Douglas Ray Scott, Midland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 702 days.

(21) Appl. No.: 13/197,024

(22) Filed: Aug. 3, 2011

(65) Prior Publication Data

US 2013/0032347 A1 Feb. 7, 2013

(51) Int. Cl.

| | |
|---|---|
| ***E21B 43/26*** | (2006.01) |
| ***E21B 43/11*** | (2006.01) |
| ***E21B 43/116*** | (2006.01) |

(52) U.S. Cl.

CPC ..... *E21B 43/11* (2013.01); *E21B 43/26* (2013.01); *E21B 43/116* (2013.01)

USPC ..... 166/297; 166/308.1

(58) Field of Classification Search

CPC ..... E21B 29/02; E21B 43/11; E21B 43/26; E21B 43/116; E21B 43/117; E21B 43/119

USPC ..... 166/297, 308.1, 55, 55.1, 55.2, 63, 386

See application file for complete search history.

(56) References Cited

U.S. PATENT DOCUMENTS

| | | | | |
|---|---|---|---|---|
| 3,089,416 | A * | 5/1963 | Gilbert | 175/4.6 |
| 3,630,282 | A * | 12/1971 | Lanmon, II | 166/297 |
| 4,676,309 | A * | 6/1987 | Gonzalez | 166/55 |
| 4,974,675 | A * | 12/1990 | Austin et al. | 166/250.1 |
| 5,564,499 | A * | 10/1996 | Willis et al. | 166/299 |
| 5,894,888 | A | 4/1999 | Wiemers et al. | |
| 6,397,947 | B1 * | 6/2002 | Behrmann et al. | 166/297 |
| 6,523,449 | B2 * | 2/2003 | Fayard et al. | 89/1.15 |
| 2005/0126783 | A1 * | 6/2005 | Grattan et al. | 166/297 |
| 2005/0194146 | A1 | 9/2005 | Barker et al. | |
| 2010/0200230 | A1 | 8/2010 | East, Jr. et al. | |
| 2013/0032347 | A1 * | 2/2013 | Parker et al. | 166/285 |

OTHER PUBLICATIONS

International Search Report and Written Opinion, KIPO, PCT/US2012/046778, Jan. 21, 2013.

* cited by examiner

*Primary Examiner* — Daniel P Stephenson
(74) *Attorney, Agent, or Firm* — Haynes and Boone, LLP

(57) ABSTRACT

A method for performing a downhole perforating and fracturing operation from a wellbore (12) positioned within a subterranean formation (18). The method includes locating a perforating gun string (24) within the wellbore (12), detonating a first perforating gun (28) to create a first discrete fracture initiation site (42) in the formation (18), repositioning the perforating gun string (24) within the wellbore (12) and detonating a second perforating gun (30) to create a second discrete fracture initiation site (44) in the formation (18). Thereafter, the method also includes pumping a fracture fluid into the wellbore (12) and propagating a single dominant planar fracture (56, 58) from each of the discrete fracture initiation sites (42, 44).

21 Claims, 7 Drawing Sheets

METHOD FOR GENERATING DISCRETE FRACTURE INITIATION SITES AND PROPAGATING DOMINANT PLANAR FRACTURES THEREFROM

TECHNICAL FIELD OF THE INVENTION

This invention relates, in general, to equipment and techniques utilized in conjunction with operations performed in relation to subterranean wells and, in particular, to a method for generating discrete fracture initiation sites and propagating dominant planar fractures therefrom.

BACKGROUND OF THE INVENTION

Without limiting the scope of the present invention, its background will be described in relation to reservoir stimulation operations performed from a wellbore that traverses a hydrocarbon bearing subterranean formation, as an example.

It is well known in the well drilling and completion art that hydraulic fracturing of a hydrocarbon bearing subterranean formation is sometimes desirable to increase the permeability of the reservoir formation in the production interval or intervals adjacent to the wellbore by performing a stimulation operation. According to conventional practice, a fracture fluid such as water, oil, oil/water emulsion, gelled water, gelled oil, carbon dioxide and nitrogen foams, water/alcohol mixtures or the like is pumped down the work string with sufficient volume and pressure to open the desired fractures in the reservoir formation. In addition, during certain stages of the fracturing operation, the fracture fluid may carry a suitable propping agent, such as sand, gravel or engineered proppants, which are deposited into the fractures and serve the purpose of holding the fractures open following the fracturing operation.

During the fracturing operation, the fracture fluid must be pumped into the formation at a flow rate that is sufficiently high enough to generate the required pressure to fracture the reservoir formation and allow the entrained proppants to enter the fractures and prop the formation structures apart. As such, the proppants in the fractures create highly conductive paths from the reservoir formation to the wellbore. Importantly, the success of the fracturing operation is dependent upon the ability to inject large volumes of hydraulic fracture fluid into desired locations within the reservoir formation at a high pressure and high flow rate.

It has been found, however, that it is difficult to achieve the desired stimulation in certain completions, such as long horizontal completions, due to uncertainty regarding fracture initiation and fracture propagation in the reservoir formation after performing conventional perforating operations. Accordingly, a need has arisen for an improved perforating and fracturing method that is operable to create communication tunnels through the casing and into the reservoir formation for fluid production. A need has also arisen for such an improved perforating and fracturing method that is operable to reduce the uncertainty regarding fracture initiation and fracture propagation in the reservoir formation.

SUMMARY OF THE INVENTION

The present invention disclosed herein is directed to an improved perforating and fracturing method that is operable to create communication tunnels through the casing and into the reservoir formation for fluid production. In addition, the improved perforating and fracturing method of the present invention is operable to reduce the uncertainty regarding fracture initiation and fracture propagation in the reservoir formation.

In one aspect, the present invention is directed to a method for performing a downhole perforating and fracturing operation from a wellbore positioned within a subterranean formation. The method includes locating a perforating gun string within the wellbore, detonating a first perforating gun to create a first discrete fracture initiation site in the formation, repositioning the perforating gun string within the wellbore, detonating a second perforating gun to create a second discrete fracture initiation site in the formation, pumping a fracture fluid into the wellbore and propagating a single dominant planar fracture from each of the discrete fracture initiation sites.

The method may also include setting a plug in the wellbore between a first stage and a second stage of the operation prior to detonating the first perforating gun, locating a plurality of perforating guns within the wellbore and for each undetonated perforating gun in the perforating gun string, repositioning the perforating gun string within the wellbore and detonating one of the undetonated perforating guns to create a sequence of discrete fracture initiation sites in the formation. In addition, the method may include detonating a focused explosive element, detonating a collection of shaped charges, detonating at least two shaped charges focused at one of the discrete fracture initiation sites, detonating at least three shaped charges focused at one of the discrete fracture initiation sites, detonating a circumferentially extending linear shaped charge or detonating a pair of oppositely disposed circumferentially extending linear shaped charges.

In another aspect, the present invention is directed to a method for performing a downhole perforating and fracturing operation from a wellbore positioned within a subterranean formation. The method includes locating a perforating gun string having a plurality of perforating guns within the wellbore, detonating a first perforating gun to create a first discrete fracture initiation site in the formation, for each undetonated perforating gun in the perforating gun string, repositioning the perforating gun string within the wellbore and detonating one of the undetonated perforating guns to create a sequence of discrete fracture initiation sites in the formation, pumping a fracture fluid into the wellbore and propagating a single dominant planar fracture from each of the discrete fracture initiation sites.

In a further aspect, the present invention is directed to a method for performing a downhole perforating and fracturing operation from a wellbore positioned within a subterranean formation. The method includes locating a perforating gun string having a plurality of perforating guns within the wellbore, setting a plug in the wellbore between a first stage and a second stage of the operation, for each perforating gun in the perforating gun string, repositioning the perforating gun string within the wellbore and detonating one of the perforating guns to create a sequence of discrete fracture initiation sites in the formation, pumping a fracture fluid into the wellbore and propagating a single dominant planar fracture from each of the discrete fracture initiation sites.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
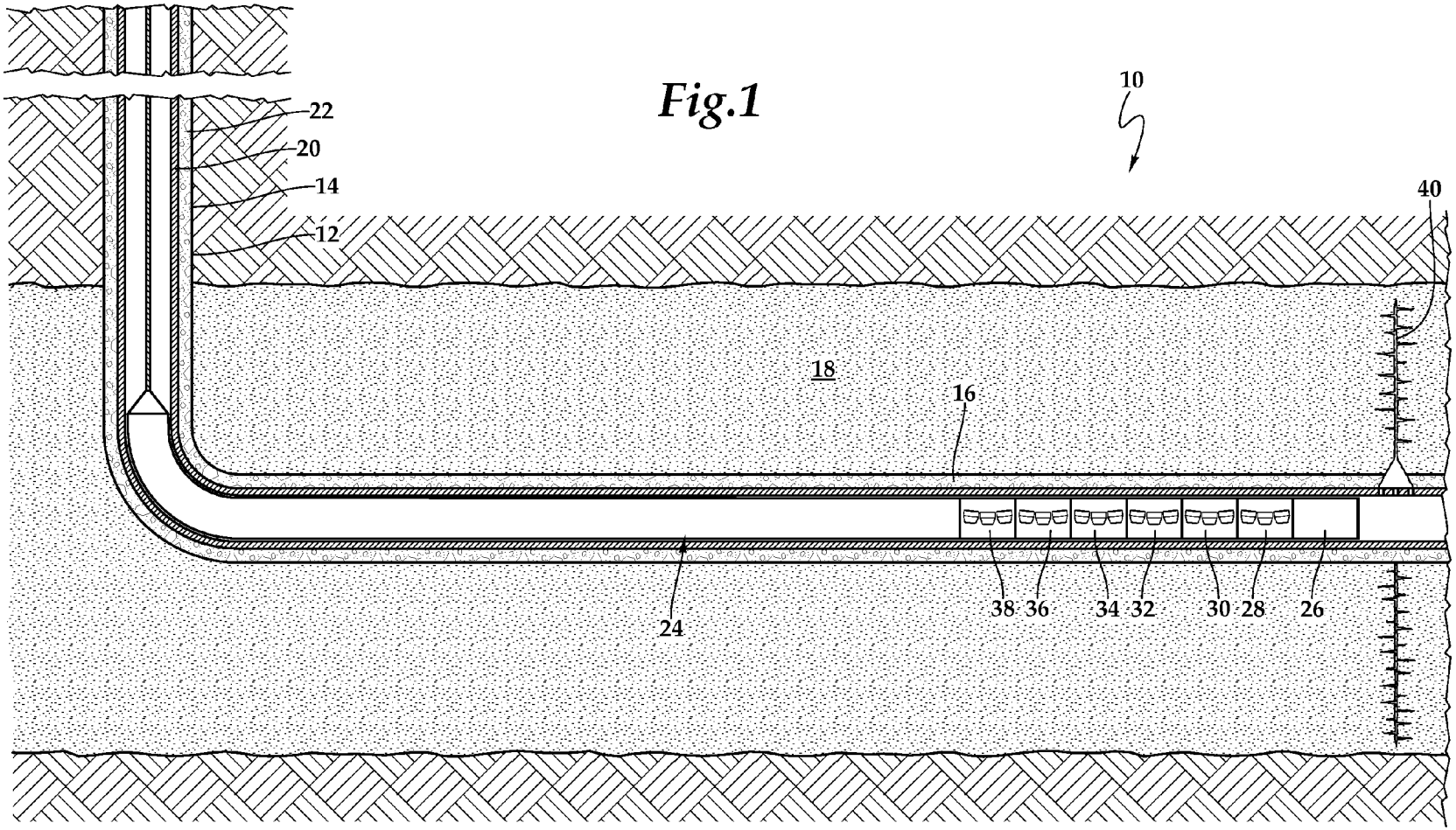
FIG. 1 is a schematic illustration of a well system prior to conducting the last stage of a perforating and fracturing operation according to an embodiment of the present invention.

Referring initially to FIG. 1, therein is depicted a well system prior to conducting the last stage of a perforating and fracturing operation according to an embodiment of the present invention that is schematically illustrated and generally designated 10. In the illustrated embodiment, a wellbore 12 extends through the various earth strata. Wellbore 12 has a substantially vertical section 14 and a substantially horizontal section 16 that extends through a hydrocarbon bearing subterranean formation 18. A casing string 20 is secured within wellbore 12 by cement 22.

In the illustrated embodiment, a workstring 24 has been deployed within wellbore 12 via a wireline. Even though FIG. 1 describes and depicts a wireline conveyed workstring, it is to be understood by those skilled in the art that workstring 24 could alternatively be tubing conveyed. At its lower end, workstring 24 includes an isolation plug 26 and a plurality of perforating guns 28, 30, 32, 34, 36, 38 that form a perforating gun string. Even though FIG. 1 describes and depicts a perforating gun string with a particular number of perforating guns, it should be understood by those skilled in the art that any number of perforating guns may be deployed without departing from the principles of the present invention.

Also depicted in FIG. 1 is a planar fracture 40 formed in formation 18 downhole of workstring 24. Planar fracture 40 represents the uppermost fracture in the prior stage of the perforating and fracturing operation. For example, substantially horizontal section 16 of wellbore 12 may extend for several thousand feet through formation 18. Use of such horizontal drilling techniques allows for an increase in the exposed wellbore length through formation 18, a reduction in the surface footprint associated with the drilling, completion and production operations as well as a reduction in costs associated with drilling, completion and production operations. Due to the length of substantially horizontal section 16, it is preferable to perform the perforating and fracturing operation in stages. For example, each stage may be several hundred feet in wellbore length. Accordingly, the perforating and fracturing operation for a wellbore such as wellbore 12 may have ten to twenty stages or more, depending upon the length of the wellbore and the length of each stage.

It should be noted by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
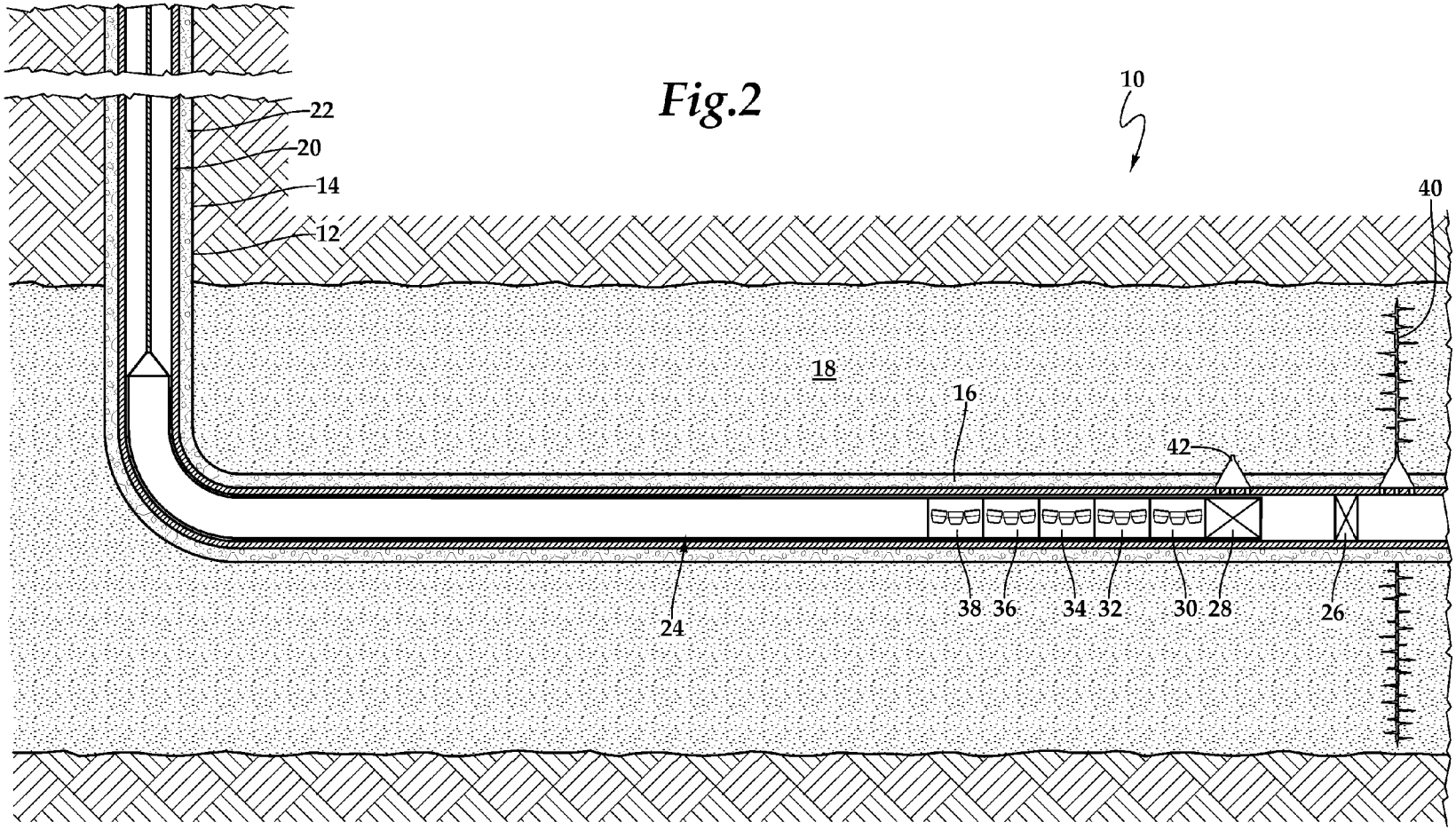
FIG. 2 is a schematic illustration of a well system during the perforating operation in the last stage of a perforating and fracturing operation according to an embodiment of the present invention.
Figure 3:
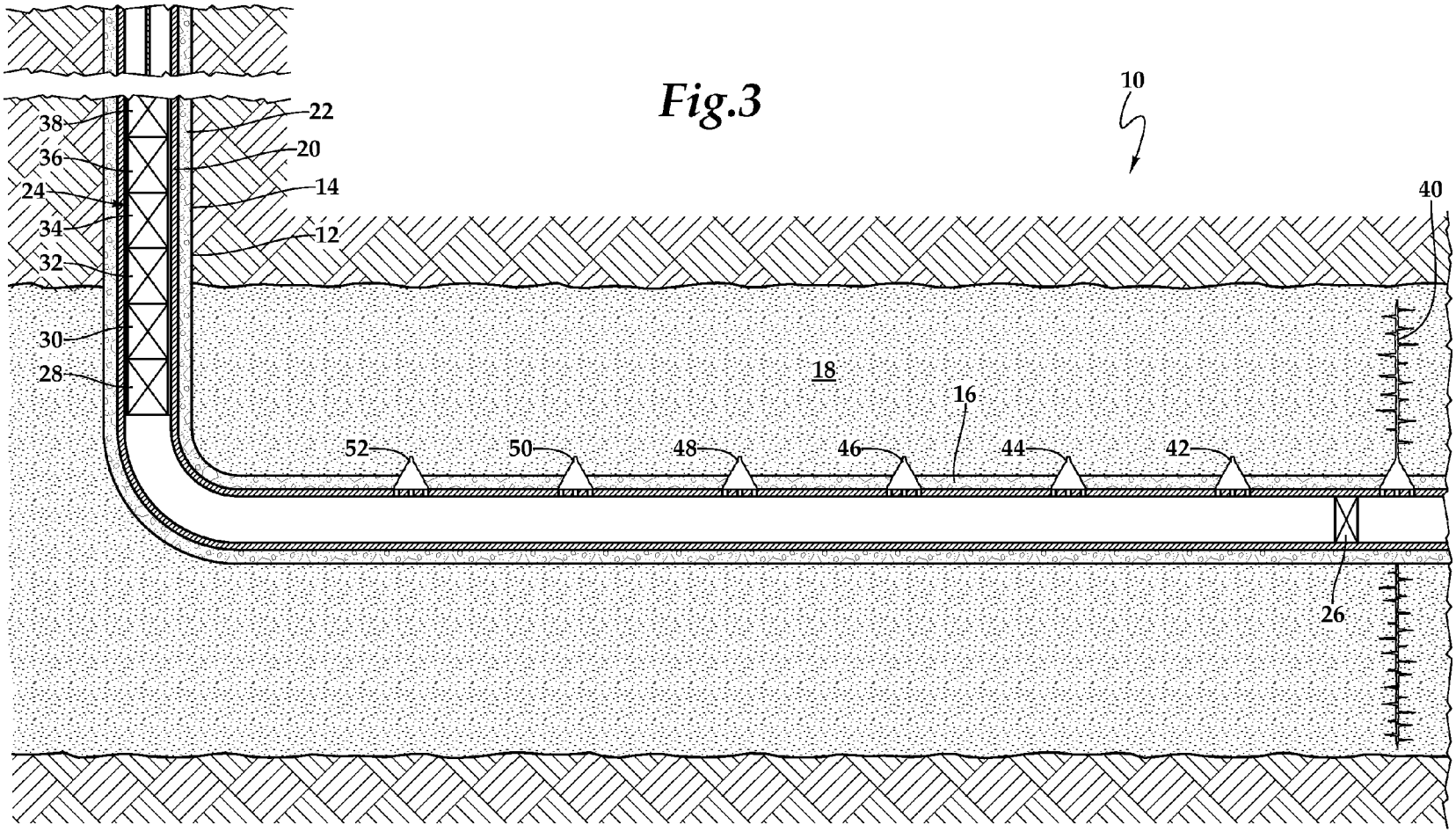
FIG. 3 is a schematic illustration of a well system after conducting the perforating operation in the last stage of a perforating and fracturing operation according to an embodiment of the present invention.

Referring now to FIG. 2, therein is depicted the well system of FIG. 1 during the perforation operation in the last stage of a perforating and fracturing operation according to an embodiment of the present invention. In general, each stage of the perforating and fracturing operation of the present invention is conducted in a similar manner. After workstring 24 is deployed in wellbore 12 in the desired location, isolation plug 26 is set to provide isolation from the lower stages. Once isolation plug 26 is set, workstring 24 is released therefrom and moved uphole to the desired location for the first perforation. The lowermost perforating gun 28 is then detonated. In the illustrated embodiment, perforating gun 28 is a triple jet perforating gun having focused shaped charges that form three closely spaced openings in one circumferential direction through casing 20. The three jets then converge in formation 18 to create a discrete fracture initiation site 42 within formation 18. Once perforating gun 28 is detonated, workstring 24 is moved uphole to the next desired location, for example fifty feet uphole, for the next perforation. The lowermost undetonated perforating gun 30 is then detonated to create a discrete fracture initiation site 44 within formation 18. This process is repeated such that each remaining lowermost undetonated perforating gun 32, 34, 36, 38 is sequentially detonated to create discrete fracture initiation sites 46, 48, 50, 52 within formation 18, as best seen in FIG. 3.

The creation of discrete fracture initiation sites 42, 44, 46, 48, 50, 52 provide a high level of certainty regarding the location of the fractures created during a subsequent hydraulic fracturing operation. This is achieved through the use of the perforating guns and perforating method of the present invention. For example, compared to conventional spiral pattern perforating guns, wherein the typical perforating interval may be between one and six feet, the perforating guns of the present invention form a much shorter perforating interval on the order of a few inches. In addition, instead of having a several foot long pattern of perforations at, for example, 60 degrees spiral increments, the perforating guns of the present invention form only a few or even a single perforation in each perforating interval.

This improved perforating technique of the present invention eliminates the creation of competing fractures that are typically present when conventional spiral pattern perforating guns are used. These competing fractures can divert fluid away from a dominant fracture and reduce stimulation effectiveness. In addition, this improved perforating technique of the present invention reduces the near wellbore tortuosity that is created when fluid attempts to exit a wellbore through a several foot long spiral pattern of small perforations. Further, this improved perforating technique of the present invention reduces the required treating pressure during the fracturing operation. Since all the perforations shot from conventional spiral pattern perforating guns commonly do not allow flow, the treating pressure is typically higher than predicted because the flow area is reduced by one or more perforations being closed or blocked, thereby increasing perforation friction pressure and reducing the capability to place proppant. As such, by injecting all the fluid entering each fracture through a single entry point instead of multiple, tortured paths, a single dominant planar fracture can be created from each discrete fracture initiation site. The single dominant planar fractures created from discrete fracture initiation sites can be modeled more accurately than conventional fractures, which leads to better estimates of production from the treated reservoir and a better overall understanding of the fracturing process and fractured formation.

Figure 4:
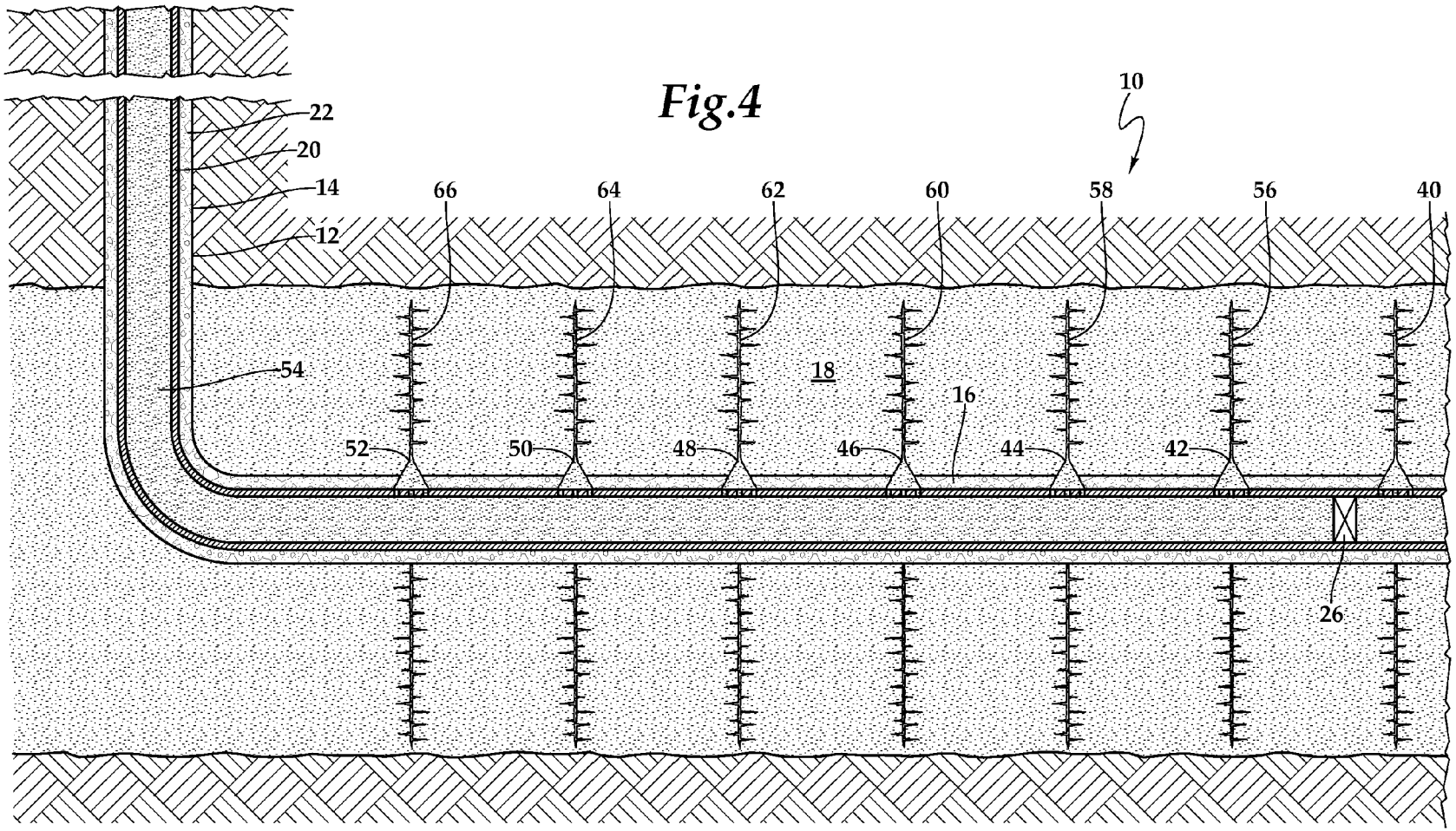
FIG. 4 is a schematic illustration of a well system during the fracture operation in the last stage of a perforating and fracturing operation according to an embodiment of the present invention.

Following the perforating operation, workstring 24 may be retrieved to the surface. A fracture fluid 54 may now be pumped downhole into wellbore 12. Fracture fluid 54 may be of any suitable type such as water, oil, oil/water emulsion, gelled water, gelled oil, carbon dioxide and nitrogen foams, water/alcohol mixtures or the like. The fracture operation preferably begins with the pumping of a pad fluid followed by a fluid carrying a propping agent, such as sand, gravel or engineered proppant. The fracture fluid is pumped downhole with sufficient flowrate and pressure to open the desired fractures in formation 18. Importantly, as discussed above, due to the creation of discrete fracture initiation sites 42, 44, 46, 48, 50, 52 within formation 18, entry of fracture fluid 54 into formation 18 and propagation of fracture fluid 54 through formation 18 is controlled and predictable. Specifically, as illustrated, discrete fracture initiation sites 42, 44, 46, 48, 50, 52 enable the creation and propagation a single dominant planer fracture 56, 58, 60, 62, 64, 66 from each discrete fracture initiation site 42, 44, 46, 48, 50, 52, as best seen in FIG. 4. The creation of dominant planer fractures 56, 58, 60, 62, 64, 66 forms high-conductivity communication paths that intersect a large area of formation 18.

In the illustrated embodiment, perforating guns 28, 30, 32, 34, 36, 38 are depicted as triple jet perforating guns having focused shaped charges that form three openings through casing 20. The three jets then converge in formation 18 to create a discrete fracture initiation site 42, 44, 46, 48, 50, 52 within formation 18. Forming discrete fracture initiation sites as described in the present invention reduces the uncertainty associated with fracture initiation and fracture propagation in formation 18 as compared with conventional perforating techniques. For example, cluster type perforating guns are typically used to perforate the casing in order to form the required communication tunnels through the casing and into the formation for fluid production. These perforating guns commonly have a plurality of shaped charge positioned in a spiral pattern or inline pattern with a desired number of shots per foot to enable a suitable production rate.

When detonated, these perforating guns form a plurality of individual perforations that extend through the casing into the formation. Unfortunately, due to the number and location of these perforations, when fracture fluid is later pumped into the wellbore, a cluster of fracture initiation points are present in the formation. This cluster of fracture initiation points hinders the creation and propagation of a dominant planer fracture. As such, an unacceptable level of uncertainty is associated with fracture initiation and fracture propagation when conventional perforating techniques are employed. Unlike conventional perforating guns, the perforating guns of the present invention create discrete fracture initiation sites within the formation. As illustrated in the present embodiment, convergence of the multiple perforating jets in the formation creates the desired discrete fracture initiation sites.

Figure 5:
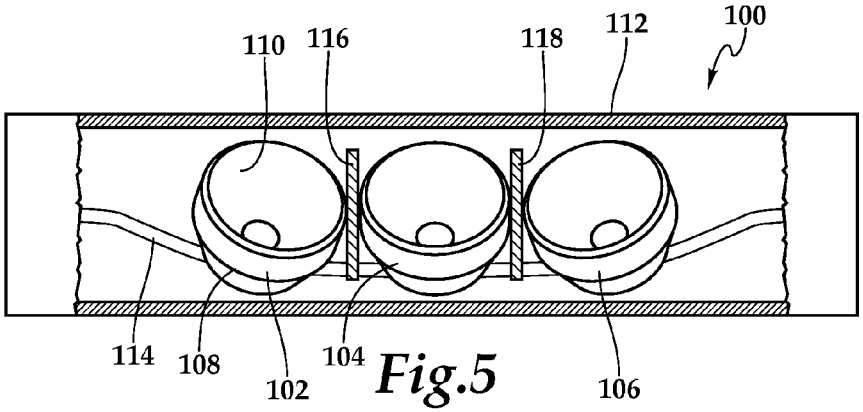
FIG. 5 is a side view partially in cut away of a perforating gun for use in a perforating and fracturing operation according to an embodiment of the present invention.

Referring now to FIG. 5, therein is depicted a perforating gun assembly that is generally designated 100. Perforating gun 100 may be suitably coupled to other similar perforating guns to form a perforating gun string or may be suitably coupled to other downhole tools or tubulars such as those described above in workstring 24. In the illustrated embodiment, perforating gun assembly 100 includes three of shaped charges 102, 104, 106. Each of the shaped charges includes an outer housing, such as housing 108 of shaped charge 102, and a liner, such as liner 110 of shaped charge 102. Disposed between each housing and liner is a quantity of high explosive. Shaped charges 102, 104, 106 are retained within a charge carrier 112 by a support member (not pictured) that maintains shaped charges 102, 104, 106 in the desire orientation of the present invention.

Preferably, housing 112 contains a detonator (not pictured) that is coupled to an electrical energy source. The detonator may be any type of detonator that is suitable for initiating a detonation in a detonating cord 114. Detonating cord 114 is operably coupled to the initiation ends of shaped charges 102, 104, 106 allowing detonating cord 114 to initiate the high explosive within shaped charges 102, 104, 106. The three shaped charges 102, 104, 106 may be referred to as a focused explosive element and will generally be referred to as a collection of shaped charges. In the illustrated embodiment, shaped charges 102, 104, 106 are positioned axially relative to one another such their discharge ends generally point in the same circumferential direction of housing 112. Accordingly, as used herein the term axially oriented will be used to describe the relationship of shaped charges within a collection of shaped charges wherein adjacent shaped charges are generally axially displaced from one another and generally point in the same circumferential direction.

In the illustrated embodiment, shaped charges 102, 104, 106 are oriented to converge toward one another. For example, center shaped charge 104 is oriented substantially perpendicular to the axis of housing 112 while outer shaped charges 102, 106 are oriented to converge toward center shaped charge 104. In one preferred orientation, the angle of convergence between adjacent shaped charges 102, 104, 106 is between about 10 degrees and about 20 degrees. Other preferred orientations include angles of convergence between about 5 degree and about 40 degrees. It should be noted that the desired angle of convergence for a particular perforating gun assembly being used to perforate a particular wellbore will be dependent on a variety of factors including the size of the shaped charges, the diameter of the perforating gun assembly and wellbore casing, the desired depth of penetration into the formation and the like. Optional attenuating barrier such as attenuating barrier 116 between shaped charges 102, 104 and attenuating barrier 118 between shaped charges 104, 106 may be used to prevent fragments of the outer two shaped charges from interfering with the jet development of the center shaped charge.

Even though FIG. 5 has depicted all of the shaped charges as having a uniform size, it should be understood by those skilled in the art that it may be desirable to have different sized shaped charges within a collection such as having larger or smaller outer shaped charges than the center shaped charge. Likewise, it may be desirable to have different types of shaped charges within a collection such as having deeper or shallower penetrating outer shaped charges than the center shaped charge. In addition, even though FIG. 5 has depicted a particular number of shaped charges within a collection, it should be understood by those skilled in the art that other numbers of shaped charges both larger and smaller than that shown are possible and are considered to be within the scope of the present invention. Further, even though FIG. 5 has depicted each of the shaped charges in a collection as being axially oriented, it should be understood by those skilled in the art that other configurations of shaped charges in a focused collection are possible and are considered to be within the scope of the present invention including, but not limited to, circumferentially phased shaped charges such as three shaped charge collections phased at (−60°, 0°, 60°), (0°, 120°, 240°) or the like.

Figure 6:
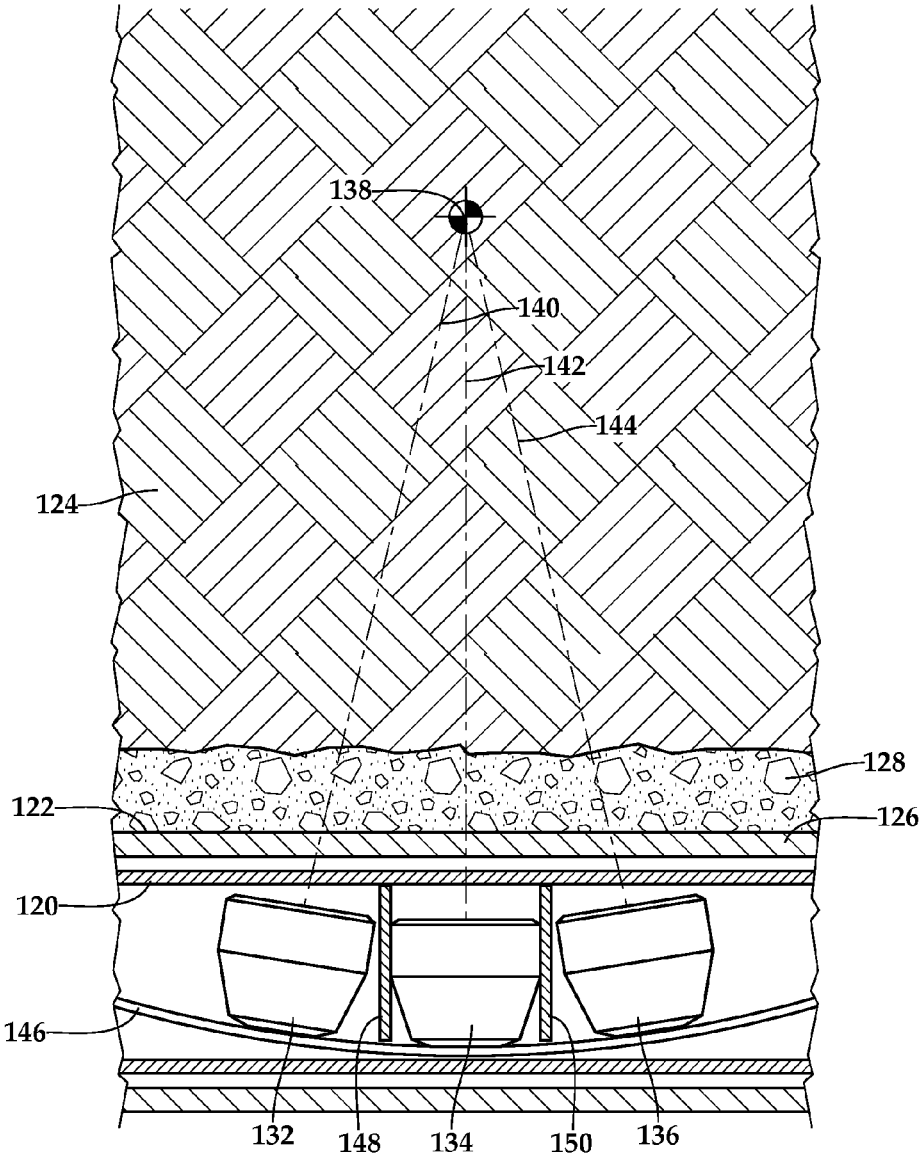
FIG. 6 is a cross sectional view of a perforating gun positioned in a well environment for use in a perforating and fracturing operation according to an embodiment of the present invention.

Referring next to FIG. 6, therein is depicted a perforating gun assembly 120 positioned in a wellbore 122 that traverses formation 124. A casing 126 lines wellbore 122 and is secured in position by cement 128. Perforating gun assembly 120 includes a substantially axially oriented collection of shaped charges 132, 134, 136. In the illustrated embodiment, shaped charges 132, 134, 136 are oriented to converge toward one another. Specifically, center shaped charge 134 is oriented substantially perpendicular to the axis of perforating gun assembly 120 while outer shaped charges 132, 136 are oriented to converge toward center shaped charge 134. More specifically, shaped charges 132, 134, 136 are each oriented toward a focal point 138 in formation 124 as indicated by dashed lines 140, 142, 144, respectively. One or more detonating cords 146 are operably coupled to shaped charges 132, 134, 136. To protect shaped charge 134, optional attenuating barriers 148, 150 are positioned respectively between shaped charges 132, 134 and shaped charges 134, 136. By orienting shaped charges 132, 134, 136 to toward focal point 138, detonation of shaped charges 132, 134, 136 results in three opening through casing 120 and the creation of a discrete fracture initiation site that generally coincides with focal point 138.

Figure 7:
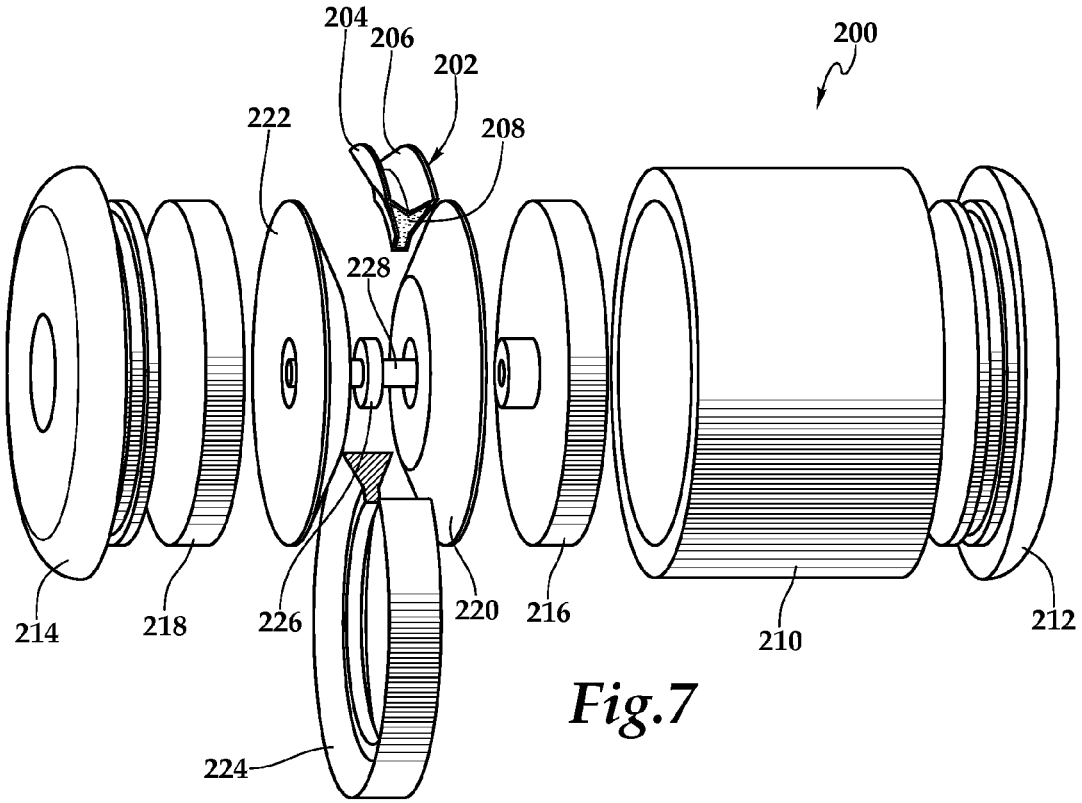
FIG. 7 is an exploded view of a perforating gun for use in a perforating and fracturing operation according to an embodiment of the present invention.

Referring now to FIG. 7, therein is depicted a perforating gun assembly that is generally designated 200. Perforating gun 200 may be suitably coupled to other similar perforating guns to form a perforating gun string or may be suitably coupled to other downhole tools or tubulars such as those described above in workstring 24. In the illustrated embodiment, perforating gun assembly 200 includes a linear shaped charge 202. Shaped charge 202 has an outer housing 204 and a liner 206 with a quantity of high explosive 208 positioned therebetween. Perforating gun 200 is formed from a housing 210 having end caps 212, 214. Disposed inside of housing 210 are support elements 216, 218, cartridge elements 220, 222 and charge retainer 224. Also disposed within perforating gun 200 is an initiator 226 and a detonating rod or cord 228. Detonating cord 228 and initiator 226 are operably coupled to shaped charge 202 for initiation of high explosive 208 within shaped charge 202. Shaped charge 202 may be referred to as a focused explosive element. In the illustrated embodiment, shaped charge 202 extends circumferentially within housing 210.

Figure 8:
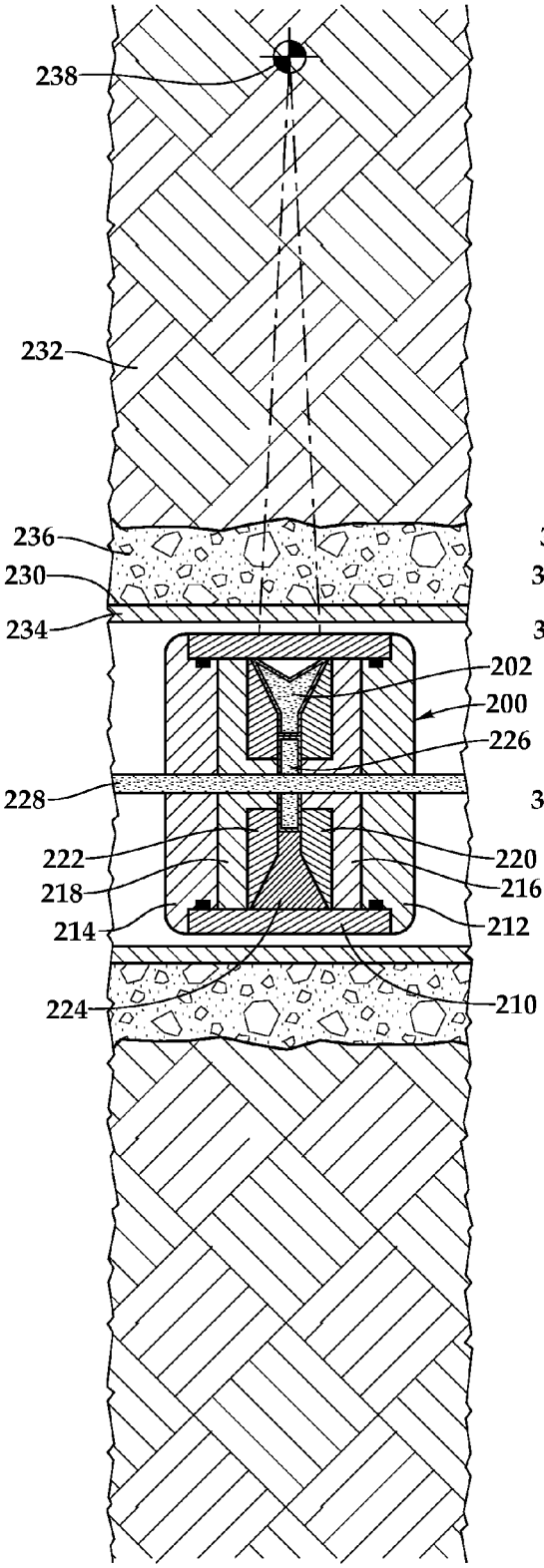
FIG. 8 is a cross sectional view of a perforating gun positioned in a well environment for use in a perforating and fracturing operation according to an embodiment of the present invention.

Referring also to FIG. 8, therein is depicted perforating gun assembly 200 positioned in a wellbore 230 that traverses formation 232. A casing 234 lines wellbore 230 and is secured in position by cement 236. Substantially circumferentially extending linear shaped charge 202 of perforating gun assembly 200 is oriented to form a single perforation through casing 234 and into formation 232 creating a discrete fracture initiation site generally indicated at 238 that encourages propagation of a single dominant planar fracture.

Even though the shaped charges depicted in FIGS. 7 and 8 have a particular circumferential length, it should be understood by those skilled in the art that shaped charges for use in the present invention could have other circumferential lengths both larger and smaller than that shown without departing from the principles of the present invention. Also, even though the shaped charges depicted in FIGS. 7 and 8 have a circumferentially convex configuration, it should be understood by those skilled in the art that shaped charges for use in the present invention could have other configurations including circumferentially concave configurations, longitudinal configurations including straight line longitudinal configurations, concave longitudinal configurations, convex longitudinal configurations and the like as well as other configurations operable to create discrete fracture initiation sites in the formation.

Figure 9:
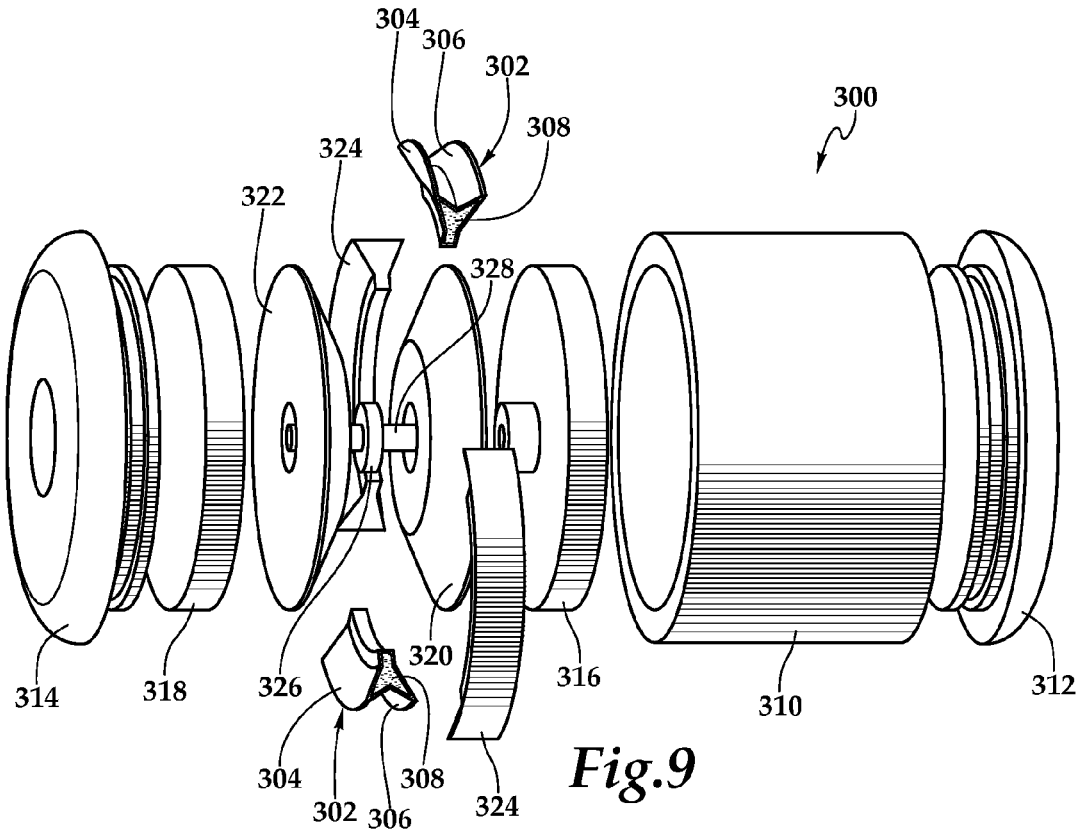
FIG. 9 is an exploded view of a perforating gun for use in a perforating and fracturing operation according to an embodiment of the present invention.

Referring now to FIG. 9, therein is depicted a perforating gun assembly that is generally designated 300. Perforating gun 300 may be suitably coupled to other similar perforating guns to form a perforating gun string or may be suitably coupled to other downhole tools or tubulars such as those described above in workstring 24. In the illustrated embodiment, perforating gun assembly 300 includes a pair of oppositely disposed linear shaped charges 302. Shaped charges 302 have an outer housings 304 and liners 306 with a quantity of high explosive 308 positioned therebetween. Perforating gun 300 is formed from a housing 310 having end caps 312, 314. Disposed inside of housing 310 are support elements 316, 318, cartridge elements 320, 322 and a two part charge retainer 324. Also disposed within perforating gun 300 is an initiator 326 and a detonating rod or cord 328. Detonating cord 328 and initiator 326 are operably coupled to shaped charges 302 for initiation of high explosive 308 within shaped charges 302. Shaped charges 302 may be referred to as a focused explosive element. In the illustrated embodiment, shaped charges 302 extend circumferentially within housing 310.

Figure 10:
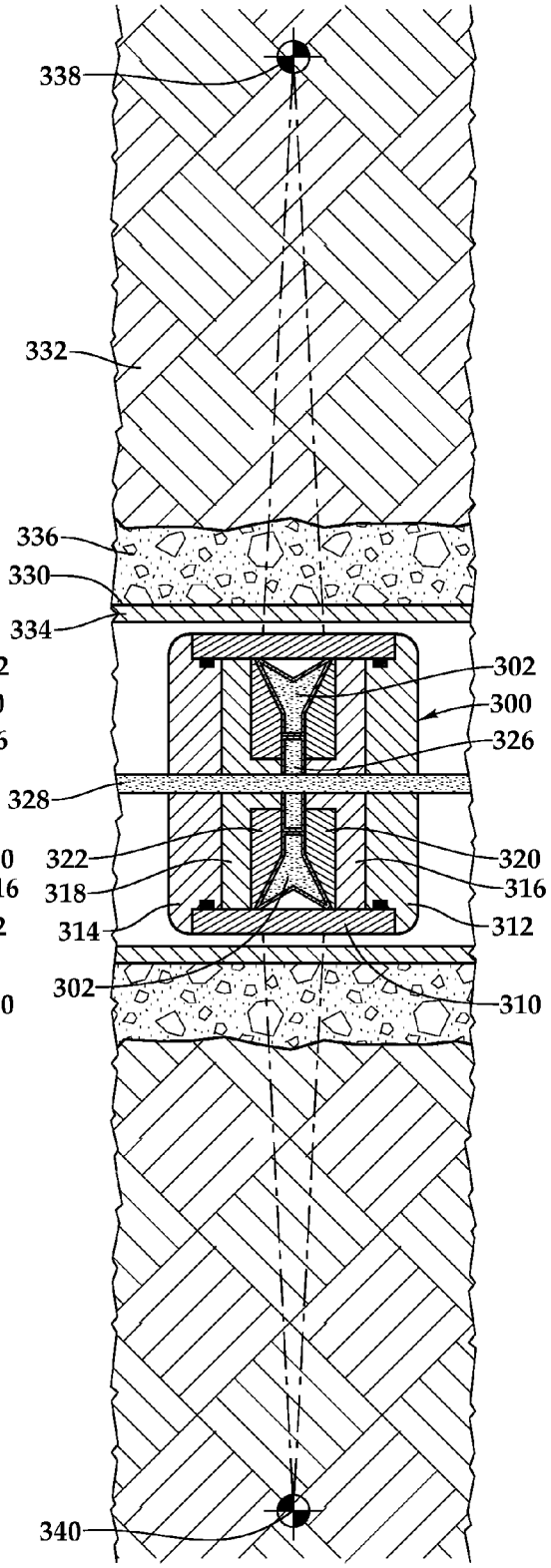
FIG. 10 is a cross sectional view of a perforating gun positioned in a well environment for use in a perforating and fracturing operation according to an embodiment of the present invention.

Referring also to FIG. 10, therein is depicted perforating gun assembly 300 positioned in a wellbore 328 that traverses formation 330. A casing 332 lines wellbore 328 and is secured in position by cement 334. Substantially circumferentially extending linear shaped charges 302 of perforating gun assembly 300 are oriented to form a pair of single perforations through casing 332 and into formation 330 creating a pair of discrete fracture initiation sites generally indicated at 336, 338 that encourages propagation of a single dominant planar fracture.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for performing a downhole perforating and fracturing operation from a wellbore positioned within a subterranean formation, the method comprising:

locating a perforating gun string at a first downhole location within the wellbore;

detonating a first perforating gun to create a first discrete fracture initiation site in the formation;

repositioning the perforating gun string to a second downhole location within the wellbore;

detonating a second perforating gun to create a second discrete fracture initiation site in the formation;

after creating the first and second discrete fracture initiation sites, pumping a fracture fluid into the wellbore; and propagating a single dominant planar fracture from each of the first and second discrete fracture initiation sites.

2. The method as recited in claim 1 further comprising setting a plug in the wellbore between a first stage and a second stage of the operation prior to detonating the first perforating gun.

3. The method as recited in claim 1 wherein locating the perforating gun string within the wellbore further comprises locating a plurality of perforating guns within the wellbore.

4. The method as recited in claim 3 further comprising, for each undetonated perforating gun in the perforating gun string, repositioning the perforating gun string within the wellbore and detonating one of the undetonated perforating guns to create a sequence of discrete fracture initiation sites in the formation.

5. The method as recited in claim 1 wherein detonating each of the perforating guns further comprises detonating a focused explosive element.

6. The method as recited in claim 5 wherein detonating each of the focused explosive elements further comprises detonating a collection of shaped charges.

7. The method as recited in claim 6 wherein detonating each of the collections of shaped charges further comprises detonating at least two shaped charges focused at one of the discrete fracture initiation sites.

8. The method as recited in claim 6 wherein detonating each of the collections of shaped charges further comprises detonating at least three shaped charges focused at one of the discrete fracture initiation sites.

9. The method as recited in claim 5 wherein detonating each of the focused explosive elements further comprises detonating a circumferentially extending linear shaped charge.

10. The method as recited in claim 5 wherein detonating each of the focused explosive elements further comprises detonating a pair of oppositely disposed circumferentially extending linear shaped charges.

11. A method for performing a downhole perforating and fracturing operation from a wellbore positioned within a subterranean formation, the method comprising:

locating a perforating gun string having a plurality of perforating guns at a first downhole location within the wellbore;

detonating a first perforating gun to create a first discrete fracture initiation site in the formation;

for each undetonated perforating gun in the perforating gun string, repositioning the perforating gun string to another downhole location within the wellbore and detonating one of the undetonated perforating guns to create a sequence of discrete fracture initiation sites in the formation;

after creating the sequence discrete fracture initiation sites, pumping a fracture fluid into the wellbore; and propagating a single dominant planar fracture from each of the discrete fracture initiation sites of the sequence discrete fracture initiation sites.

12. The method as recited in claim 11 further comprising setting a plug in the wellbore between a first stage and a second stage of the operation prior to detonating the first perforating gun.

13. The method as recited in claim 11 wherein detonating each of the perforating guns further comprises detonating at least two shaped charges focused at one of the discrete fracture initiation sites.

14. The method as recited in claim 11 wherein detonating each of the perforating guns further comprises detonating at least three shaped charges focused at one of the discrete fracture initiation sites.

15. The method as recited in claim 11 wherein detonating each of the perforating guns further comprises detonating a circumferentially extending linear shaped charge.

16. The method as recited in claim 11 wherein detonating each of the perforating guns further comprises detonating a pair of oppositely disposed circumferentially extending linear shaped charges.

17. A method for performing a downhole perforating and fracturing operation from a wellbore positioned within a subterranean formation, the method comprising:

locating a perforating gun string having a plurality of perforating guns at a first downhole location within the wellbore;

setting a plug in the wellbore between a first stage and a second stage of the operation;

for each perforating gun in the perforating gun string, repositioning the perforating gun string to another downhole location within the wellbore and detonating one of the perforating guns to create a sequence of discrete fracture initiation sites in the formation;

after creating the sequence discrete fracture initiation sites, pumping a fracture fluid into the wellbore; and propagating a single dominant planar fracture from each of the discrete fracture initiation sites of the sequence discrete fracture initiation sites.

18. The method as recited in claim 17 wherein detonating each of the perforating guns further comprises detonating at least two shaped charges focused at one of the discrete fracture initiation sites.

19. The method as recited in claim 17 wherein detonating each of the perforating guns further comprises detonating at least three shaped charges focused at one of the discrete fracture initiation sites.

20. The method as recited in claim 17 wherein detonating each of the perforating guns further comprises detonating a circumferentially extending linear shaped charge.

21. The method as recited in claim 17 wherein detonating each of the perforating guns further comprises detonating a pair of oppositely disposed circumferentially extending linear shaped charges.

* * * * *